US011178960B1

(12) United States Patent
Innello

(10) Patent No.: US 11,178,960 B1
(45) Date of Patent: Nov. 23, 2021

(54) DISPOSABLE EDGE PEN

(71) Applicant: Katianna C Innello, North Bay Village, FL (US)

(72) Inventor: Katianna C Innello, North Bay Village, FL (US)

( * ) Notice: Subject to any disclaimer, the term of this patent is extended or adjusted under 35 U.S.C. 154(b) by 0 days.

(21) Appl. No.: 17/207,199

(22) Filed: Mar. 19, 2021

(51) Int. Cl.
*A46B 5/00* (2006.01)
*A46B 9/04* (2006.01)

(52) U.S. Cl.
CPC ..... *A46B 5/00* (2013.01); *A46B 9/04* (2013.01); *A46B 2200/104* (2013.01)

(58) Field of Classification Search
CPC ..... A46B 5/00; A46B 15/00; A46B 9/04
See application file for complete search history.

(56) References Cited

U.S. PATENT DOCUMENTS 3,451,723 A * 6/1969 Marks ..... A46B 9/02 300/21
2019/0255305 A1* 8/2019 Hendriks ..... A61K 8/36

FOREIGN PATENT DOCUMENTS

CN 201472859 U * 5/2010
WO WO-2019165504 A1 * 9/2019 ..... A46B 5/00

OTHER PUBLICATIONS

May 2010 See Pdf for complete Chinese Patent 201472859.*

* cited by examiner

*Primary Examiner* — Michael D Jennings
(74) *Attorney, Agent, or Firm* — Ruben Alcoba, Esq.

(57) ABSTRACT

A disposable edge pen that is used to stylize the baby hairs of a black woman: the disposable edge pen comprises of an edge brush, a container that holds a styling gel, a screw mechanism that pushes the gel out of the container, a dispensing gel cap that holds the styling gel within the container, and a cap that covers the dispensing gel cap.

3 Claims, 4 Drawing Sheets

DISPOSABLE EDGE PEN

TECHNICAL FIELD

The present invention pertains to a disposable edge pen for hair styling design.

BACKGROUND

The present invention is designed to stylize the baby hairs of an African American woman.

The hair on the edges of a black woman's scalp is typically called baby hairs. Some black women stylize their baby hairs by applying a gel to their baby hair with their fingers and then using a small brush to stylize the baby hairs.

The inventor of the present invention realized that she had to eliminate the inconvenience of having to carry a container of gel and an edge brush to stylize her baby hairs. Besides the inconvenience of having to carry the container and the brush, she also dirtied her fingers when applying the gel to her baby hairs.

The above inconveniences led her to conceive of the present invention. She realized that, if she could design a small disposable tube container that could have a gel applicator on one side and a small edge brush on the other side, she could provide black women with a device that would eliminate the inconveniences recited above.

The present invention resolves the need of having to carry multiple devices to stylize a black woman's baby hairs, while also providing a device that does not require a black woman to dirty her fingers when applying the gel to her baby hairs.

SUMMARY

The present invention is directed to a disposable edge pen that is used to stylize a black woman's baby hair.

The disposable edge pen comprises of an edge brush, a container that holds a styling gel, a screw mechanism that pushes the gel out of the container, a dispensing gel cap that holds the styling gel within the container, and a cap that covers the dispensing gel cap.

An object of the present invention is to provide a disposable edge pen that can be used to stylize a black woman's baby hairs.

Another object of the present invention is to provide a disposable edge pen that can be used by a woman to apply a gel to her baby hairs without having her dirty her fingers.

DRAWINGS

These and other features, aspects, and advantages of the present invention will become better understood with regards to the following description, appended claims, and drawings where:

DESCRIPTION

Figure 1:
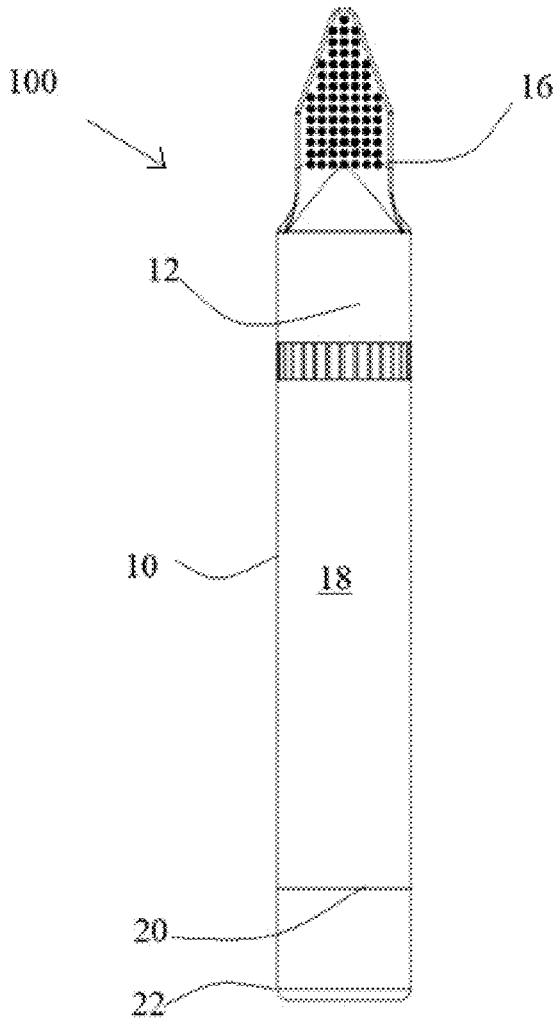
FIG. 1 is a front view of a disposable edge pen.
Figure 2:
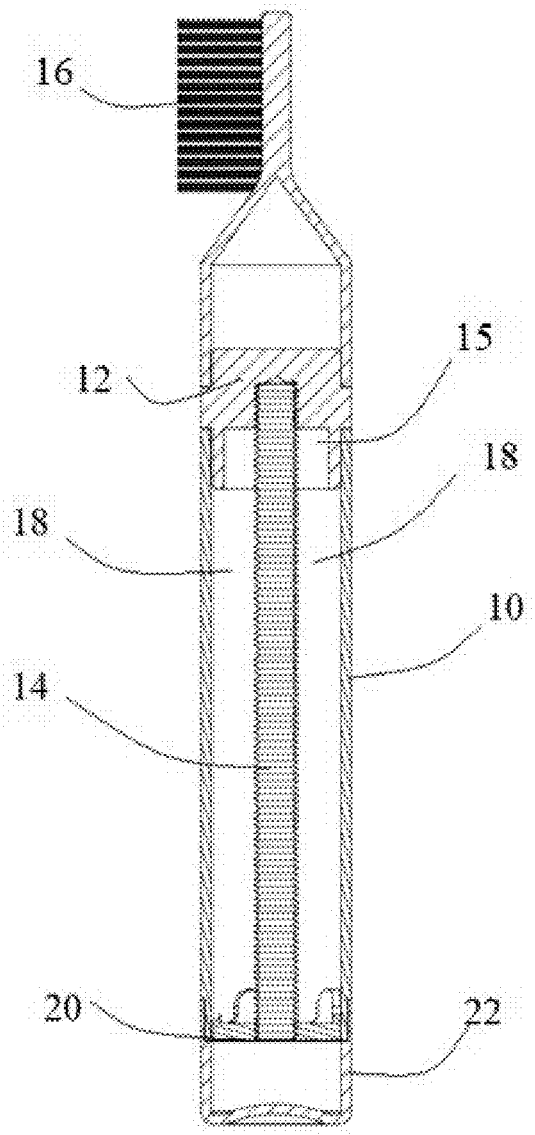
FIG. 2 is a front sectional view of the disposable edge pen.
Figure 3:
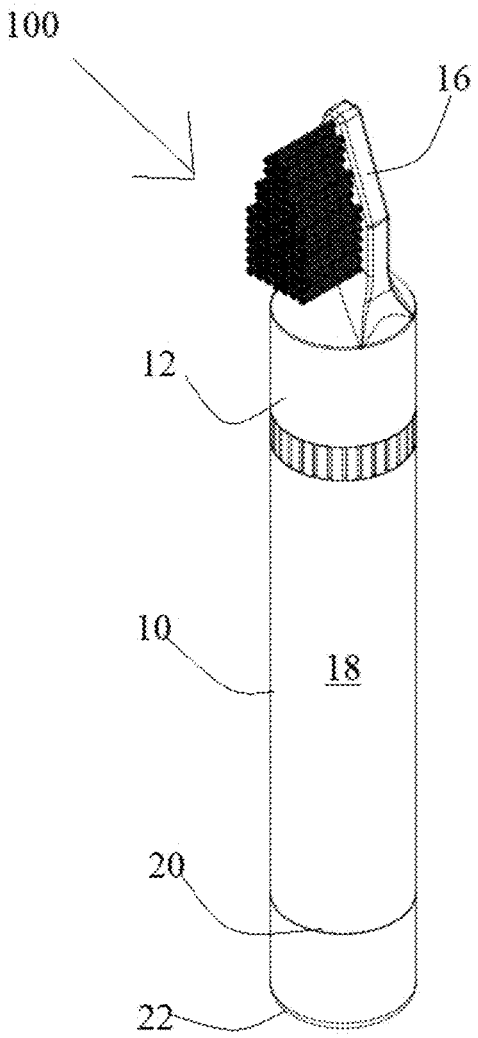
FIG. 3 is a perspective view of the disposable edge pen.
Figure 4:
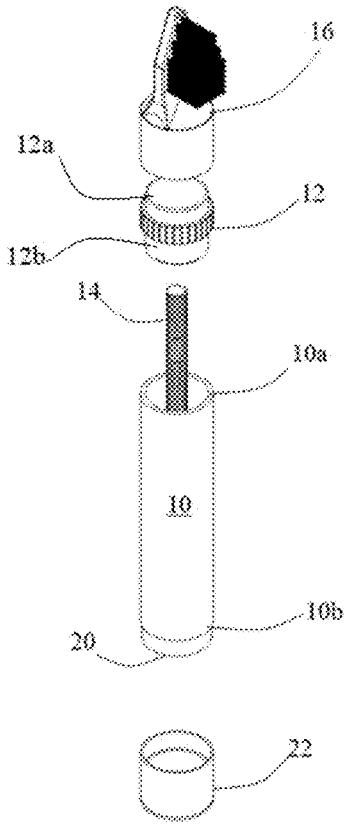
FIG. 4 is an exploded view of the disposable edge pen.

Referring to FIGS. 1-4, the present invention is a disposable edge pen 100 that is used to stylize the baby hairs of a black woman. The disposable edge pen 100 comprises of a container 10 that has a first open side 10*a* and a second open side 10*b*. A manual screw drive 12 that attaches to a central threaded spindle 14. A platform 15 that is screwed on the central threaded spindle 14 to a position that is adjacent to the manual screw drive 12, the manual screw drive 12 has a first side 12*a* and a second side 12*b*, the second side 12*b* of the manual screw drive 12 is attached to the first open side 10*a* of the container 10. An edge brush 16 that is attached to a first side 12*a* of the manual screw drive 12. A gel 18 that is inserted within the second open side 10*b* of the container 10. A dispensing gel cap 20 that is attached to the second open side 10*b* of the container 10. And, a cap 22 that is placed over the dispensing gel cap 20.

In preferred embodiments, the disposable edge pen 100 measures at least two and a half inches from the edge brush 16 to the cap 20.

In preferred embodiments, the container 10 is a circular container.

In some embodiments, the gel 18 can be made of a waxy substance.

An advantage of the present invention is that it provides a disposable edge pen that is used to stylize a black woman's baby hair.

Another advantage of the present invention is that it provides a disposable edge pen that is used by a woman to apply a gel to her baby hairs without having her dirty her fingers.

The embodiments of the disposable edge pen described herein are exemplary and numerous modifications, combinations, variations, and rearrangements can be readily envisioned to achieve an equivalent result, all of which are intended to be embraced within the scope of the appended claims. Further, nothing in the above-provided discussions of the disposable edge pen should be construed as limiting the invention to an embodiment or a combination of embodiments. The scope of the invention is defined by the drawings, the written description, and the appended claims.

What is claimed is:

1. A disposable edge pen that is used to stylize the baby hairs of a black woman, the disposable edge pen comprises of:

a container that has a first open side and a second open side;

a manual screw drive that attaches to a central threaded spindle;

a platform that is screwed on the central threaded spindle to a position that is adjacent to the manual screw drive, the manual screw drive has a first side and a second side, the second side of the manual screw drive is attached to the first open side of the container;

an edge brush that is attached to a first side of the manual screw drive, the edge brush is configured to allow a user to stylize the user's baby hairs after a waxy substance is applied on the user's baby hairs;

a waxy substance that is inserted within the second open side of the container;

a dispensing gel cap that is attached to the second open side of the container, the dispensing gel cap is configured to allow a user to apply the waxy substance to the user's baby hairs prior to a user stylizing the user's baby hairs with the edge brush; and a cap that is placed over the dispensing gel cap.

2. The disposable edge pen that is used to stylize the baby hairs of a black woman of claim 1, wherein the disposable edge pen measures at least two and a half inches from the edge brush to the cap.

3. The disposable edge pen that is used to stylize the baby hairs of a black woman of claim 1, wherein the container is a circular container.

* * * * *